United States Patent [19]

Bentley

[11] 4,184,331

[45] Jan. 22, 1980

[54] PUMPING SYSTEM

[75] Inventor: Peter N. Bentley, Caverswall, England

[73] Assignee: Thomas Willett & Company Limited, Stoke-on-Trent, England

[21] Appl. No.: 881,645

[22] Filed: Feb. 27, 1978

[30] Foreign Application Priority Data

Apr. 6, 1977 [GB] United Kingdom ..... 14652/77

[51] Int. Cl.[2] ..... F15B 13/09

[52] U.S. Cl. ..... 60/375; 60/430; 60/486; 91/304; 417/900

[58] Field of Search ..... 60/369, 375, 383, 428, 60/429, 430, 486; 91/304, 282, 6; 417/390, 900

[56] References Cited

U.S. PATENT DOCUMENTS

| | | | |
|---|---|---|---|
| 1,848,006 | 3/1932 | Ferris | 60/428 |
| 2,419,375 | 4/1947 | Shartle | 60/375 |

*Primary Examiner*—Edgar W. Geoghegan
*Attorney, Agent, or Firm*—Marshall & Yeasting

[57] ABSTRACT

A pumping system for pumping liquid clay or slip into a filter press comprises a hydraulically-powered double-acting ram for pumping the slip and a hydraulic control circuit for the ram. The control circuit includes a pair of hydraulic pumps one of which provides a high pressure, low volume delivery and the other of which provides a low pressure high volume delivery, and valves controlling the supply of oil from these pumps to the ram according to the resistance encountered by the ram.

4 Claims, 1 Drawing Figure

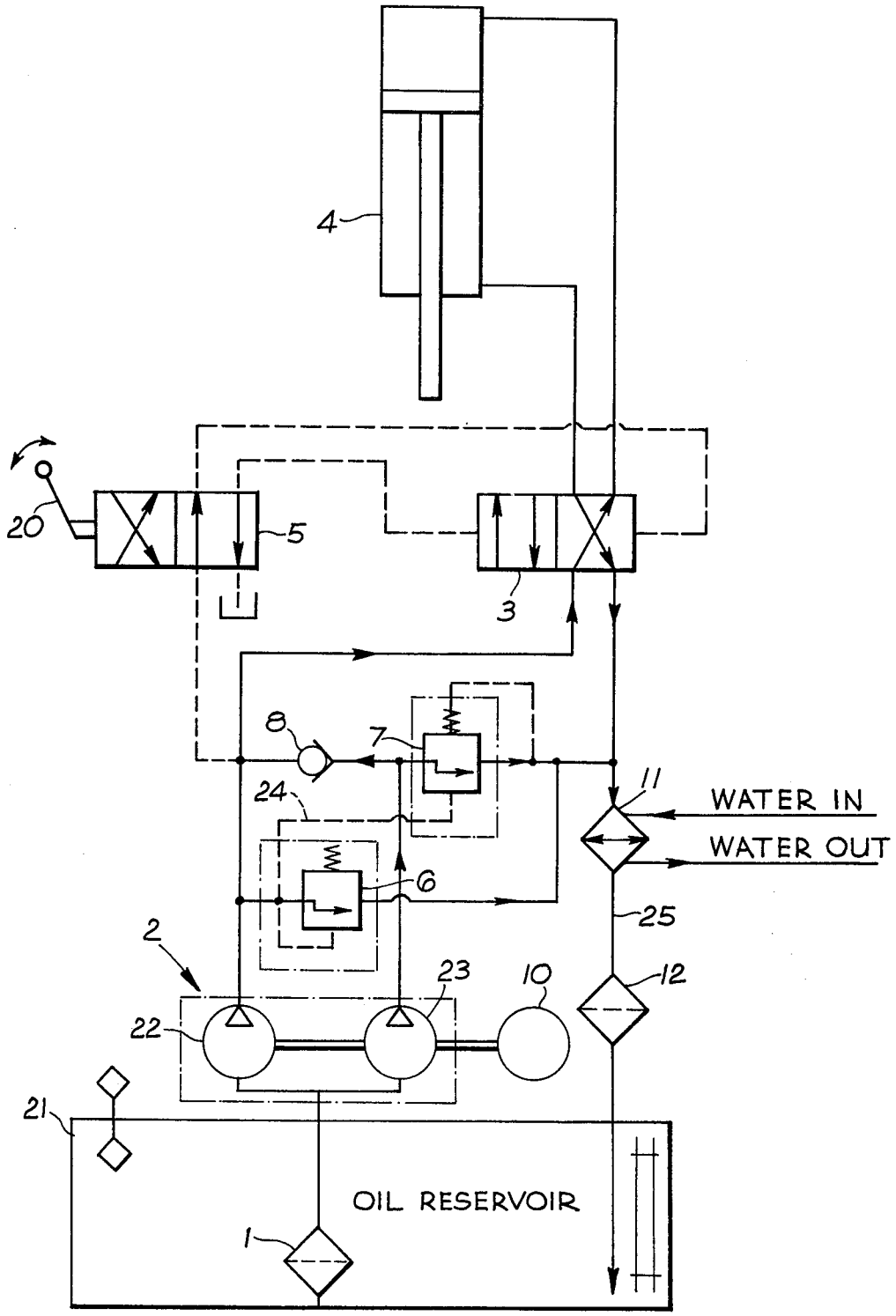
4
20
5
3
8
7
24
11
WATER IN
WATER OUT
6
25
2
23
10
12
22
21
OIL RESERVOIR
1

PUMPING SYSTEM

This invention relates to a pumping system which can be used, for example, in pumping liquid clay or slip into a filter press, and which includes a double-acting ram for reciprocating the plunger of the pumping unit, the ram being controlled automatically through a four-way hydraulic valve which, under the control of a pilot valve, reverses the direction of fluid flow to and from the ram cylinder at each end of the operating stroke, the pressure of the sludge or suspension delivered by the pumping unit being directly related to the pressure of hydraulic fluid in the ram. Such a pumping system is hereinafter called a pumping system of the kind specified.

In one known pumping system of this kind, fluid is supplied to the ram via a vane pump and the pressure of the fluid within the ram is limited by a pressure relief valve upstream of the four-way valve which by-passes fluid back to the sump when a certain pressure is attained. Up to this pressure, the stroke rate of the ram and hence the output of the system remains substantially constant but beyond this point, the stroke rate and output decrease rapidly. At high pressures therefore, the vane pump continues to handle the same quantity of fluid as at low pressures but, because of the relief valve, only a small proportion of this fluid is delivered to the ram. Consequently the motor driving the vane pump consumes full power at high pressures even though the output is low and the excess power is dissipated as heat largely in the fluid by-passed to the sump.

The object of the present invention is to overcome or at least reduce the above-mentioned drawback.

According to the present invention we provide a pumping system of the kind specified in which a pair of hydraulic pumps are provided for delivering fluid to the hydraulic ram, one of whose output can be by-passed to the sump via said pressure-relief valve and the other of whose output can be returned to the sump under lower pressure conditions via a further valve which opens when the pressure in the ram cylinder attains a certain value below the relief pressure of the first valve.

In the preferred embodiment of the invention, said pair of hydraulic pumps is embodied within a twin impeller vane pump, one section of which provides a high pressure, low volume delivery and the other section of which provides a low pressure, high volume delivery, said one section having the pressure relief valve associated with it and the other section being associated with said further valve. Conveniently the opening and closing of said further valve is governed by the condition of the pressure relief valve.

By this arrangement, when the pressure within the ram cylinder approaches its maximum then, during the working stroke of the ram, only a small quantity of oil is supplied to the cylinder, the majority of the oil being returned to sump via said further valve under normal pressure. Consequently the motor does not need to operate at full power and a lesser amount of heat is dissipated into the oil. When the ram completes its working stroke, the cylinder pressure drops and consequently both pumps may deliver to the ram during the return stroke to effect rapid return.

The invention will now be described by way of example with reference to the accompanying drawing which is a hydraulic circuit diagram of the pumping system of the invention.

As shown, the pumping system comprises a double-acting hydraulic ram 4 whose piston is, in use, coupled to the plunger of a clay slip pump (not shown) for delivering the slip into a filter press. The pump may be of the type disclosed in for example British Pat. No. 677,136 to which reference should be made for further details. A four-way valve 3 is associated with the ram 4 and is controlled by a pilot valve 5 which, in turn, is controlled by a mechanical coupling 20 (for instance as shown in British Pat. No. 677,136) so that the valve 3 is changed over each time the ram reaches the end of a working or return stroke. Oil is supplied to the valve 3 by a pair of hydraulic pumps embodied in a twin impeller vane pump 2 driven by electric motor 10 and connected to the oil reservoir 21 via a suction filter 1. The pump 2 comprises a high pressure section 22 and a low pressure section 23.

The high pressure section 22 of the pump 2 can be by-passed to the reservoir 21 via pressure relief valve 6, cooler 11 and return line filter 12 so that when the pressure in the ram cylinder attains a preselected value, only a portion of the output of the high pressure section is fed to the ram. The low pressure section 23 is connected to the valve 3 via non-return valve 8 and it can also be by-passed to the sump via an unloader valve 7 and the return line 25. The valve 7 is controlled by a pilot line 24 from valve 6 so that valve 7 opens when a preset pressure below that of the valve 6 has been attained.

During normal pressure operation, i.e. at pressures well below the relief pressure of valve 6, both sections of the pump deliver their full outputs to the ram. However, when the pressure increases, the valve 7 opens under the control of the fluid pressure in pilot line 24 from the valve 6 and begins to by-pass the output of the low pressure section 22 back to the sump. As the pressure builds up further and reaches the preset relief pressure of valve 6, the latter begins to by-pass the output of the high pressure section 22 of the pump back to the sump. It will be noted that when the ram completes its working stroke, the return stroke will be at a somewhat lower pressure and consequently valves 6 and 7 close to permit the high pressure and low pressure sections 22, 23 to deliver their entire outputs to the ram thus producing a rapid return stroke.

What we claim is:

1. A pumping system including a pumping unit for handling solids-containing liquids or slurry, said unit having a plunger, a double-acting ram for reciprocating the plunger of the pumping unit to effect a suction stroke and a displacement stroke of the plunger whereby, in use, liquid or slurry is drawn into and discharged from the pumping unit, the ram being controlled automatically through a four-way hydraulic valve which, under the control of a pilot valve, reverses the direction of fluid flow to and from the ram cylinder at each end of the operating stroke, the pressure of the sludge or suspension delivered by the pumping unit being directly related to the pressure of hydraulic fluid in the ram, characterised by first and second hydraulic pumps for delivering fluid to the hydraulic ram, the first hydraulic pump having a high pressure, low volume delivery characteristic and the second one having a low pressure, high volume delivery characteristic, a sump, a pressure relief valve connected to the output of the first pump to by-pass the output thereof to the sump when the relief pressure is attained and a further valve which opens when the pressure in the ram cylinder attains a certain value below the relief pressure of the first pressure relief valve to by-pass the output of the second pump to the sump.

2. A pumping system as claimed in claim 1 in which said pair of hydraulic pumps is embodied within a twin impeller vane pump, one section of which provides the high pressure, low volume delivery and the other section of which provides the low pressure, high volume delivery.

3. A pumping system as claimed in claim 1 wherein opening and closing of said further valve is governed by the condition of the first mentioned pressure relief valve.

4. A pumping system as claimed in claim 1 in which both of said pressure-relief valves are adjustable to enable them to be set so as to respond to preselected pressures.

* * * * *